US006685242B2

(12) United States Patent
Furner

(10) Patent No.: US 6,685,242 B2
(45) Date of Patent: Feb. 3, 2004

(54) DOOR LOCK

(75) Inventor: Ronald T. Furner, Crescent Fort Macquarie (AU)

(73) Assignee: Interlox International Pty (USA) Ltd, Burbank, CA (US)

( * ) Notice: Subject to any disclaimer, the term of this patent is extended or adjusted under 35 U.S.C. 154(b) by 12 days.

(21) Appl. No.: 10/119,670

(22) Filed: Apr. 9, 2002

(65) Prior Publication Data

US 2002/0145292 A1 Oct. 10, 2002

(51) Int. Cl.[7] ..... E05B 15/02
(52) U.S. Cl. ..... 292/341.16; 292/DIG. 19
(58) Field of Search ..... 292/201, 144, 292/341.16, DIG. 19

(56) References Cited

U.S. PATENT DOCUMENTS 257,725 A * 5/1882 Lalor
420,834 A * 2/1890 Seib
936,214 A 10/1909 Bowes
1,657,423 A 1/1928 Van Duzer
2,910,859 A * 11/1959 Allen
3,521,921 A * 7/1970 Miyazaki ..... 292/201
3,667,793 A * 6/1972 Varrin ..... 292/216
3,874,715 A 4/1975 Beudat
3,890,813 A * 6/1975 Cothron ..... 70/92
3,905,626 A 9/1975 Myers
4,056,276 A * 11/1977 Jarvis ..... 292/201
4,262,830 A * 4/1981 Haves ..... 224/42.06
4,648,253 A * 3/1987 Imhoff ..... 70/135
5,020,277 A * 6/1991 Hellriegel ..... 49/400

* cited by examiner

*Primary Examiner*—Gary Estremsky
(74) *Attorney, Agent, or Firm*—Sheldon & Mak

(57) ABSTRACT

A door lock mounted within a door frame comprises a rotatable spindle having shell portions that rotatably extend beyond the door frame between open and locked position. The shell portions define a channel having sides spaced apart to receive and restrain a door edge when in the locked position. In the locked position, a cam follower locking arrangement prevents the spindle from returning to the open positoin. Push button, solenoid and push key activation of a lock releasing lever releases the door lock so as to return the door lock to the open position.

1 Claim, 4 Drawing Sheets

DOOR LOCK

RELATED APPLICATIONS

Applicant hereby claims the benefit of an earlier filing date of Apr. 10, 2001 under 35 U.S.C. §119 based upon Australian provisional application Serial No. PR 4317 filed in the Australian Patent Office Apr. 10, 2001 by the present inventor, Ronald T. Furner.

FIELD OF THE INVENTION

The field of the invention relates to door locking mechanisms, more particularly to a locking mechanism that is mounted within a door frame as distinct from being mounted within a door.

BACKGROUND OF THE INVENTION

Door locking mechanisms is a highly developed art. Complex locking mechanisms employ many methods and techniques but generally involve the placement of the mechanism within a door. Unless strict precautions are taken, often times such locks are generally accessible and may be susceptible to being tampered in burglary attempts. Moreover, traditional locks have a door to door frame engagement technique which usually involves a locking or "dead" bolt extendable from a door that is received by a mating receptacle in a door jam or door frame. Accordingly, only one point of locking engagement is provided placing the security aspect of the lock at risk.

Furthermore, the door lock mechanisms known in the art tend to be complex with regard to structure and function. What is needed, therefore, is a door locking mechanism that eliminates the complexities of known devices while providing enhanced locking capability with burglar-proof or tamper-proof characteristics.

SUMMARY OF THE INVENTION

The present invention provides a significant improvement over presently available complex door locks. A prime characteristic of the present invention is simplicity of mechanism and operation as well as enhanced security capability partly as a function of being housed within a door frame as distinct from being housed within a door, and an extended grip area for gripping and restraining a door when in the locked position.

The door lock, or as may be referred to as a door keeper, that serves to hold or keep a door in place in a locked position includes an essentially cylindrical rotatable spindle mounted within a door frame that rotates about a longitudinal axis. The spindle has two opposing outer shell portions that rotate in accordance with the spindle through thin slits in the door frame. The shell portions are aligned in a direction along the longitudinal dimension of the spindle and spaced apart such that in the closed position the spacing between the shell portions is appropriate to receive and restrain a door when in the locked position.

The spindle is coupled to a torsion spring that continually urges the spindle to the open position. The door lock includes a cam and cam follower type locking mechanism to maintain the door lock in a locked position until otherwise released. The cam is mounted on the spindle and includes a sliding surface and a locking surface. A cam follower in the form of the spring loaded rod is positioned adjacent the spindle and comes in contact with the cam along the sliding surface as the spindle rotates to the locked position whereupon the rod moves into contact with the locking surface under the influence of the rod spring preventing the spindle thereby from returning to the open position. The door lock also includes spindle rotation stops which prevent the spindle from rotating beyond the locked position. Further included in the door lock is a releasing lever actuated by selectable means that urges the rod off and away from the locking surface of the cam, whereupon the spindle rotates to the open position under the influence of the torsion spring. The selectable means includes solenoid retraction, push button and turn key activation.

By virtue of the present invention, the mounting of the mechanism within the door frame significantly enhances its tamper proof capability. Moreover, since the shell portions may be made of any desirable length, the door edge portion received and restrained can extend to essentially the entire length of the door edge. Furthermore, the door lock may also be used for traditional sliding doors when the edge of the door is fitted with an appropriate push arm to engage the spindle and cause it to rotate while movement of the sliding door to the closed position and a locking edge which engages a spindle shell portion in a locking interference manner to maintain the door in a locked condition.

BRIEF DESCRIPTION OF THE DRAWINGS

Referring now to the drawings in which like reference numbers represent corresponding parts throughout.

DETAILED DESCRIPTION OF PREFERRED EMBODIMENT

Figure 1:
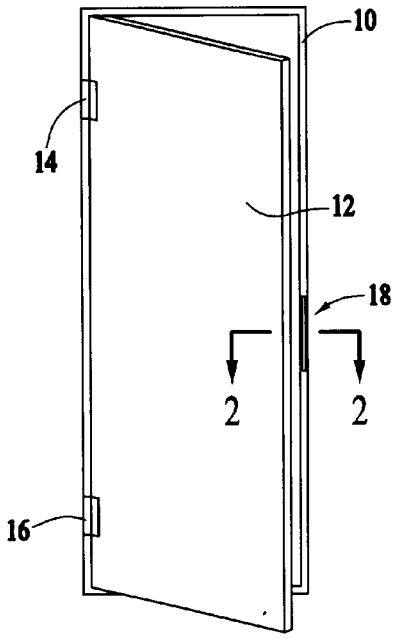
FIG. 1 is a perspective view of a door frame and a door in an open position.
Figure 4:
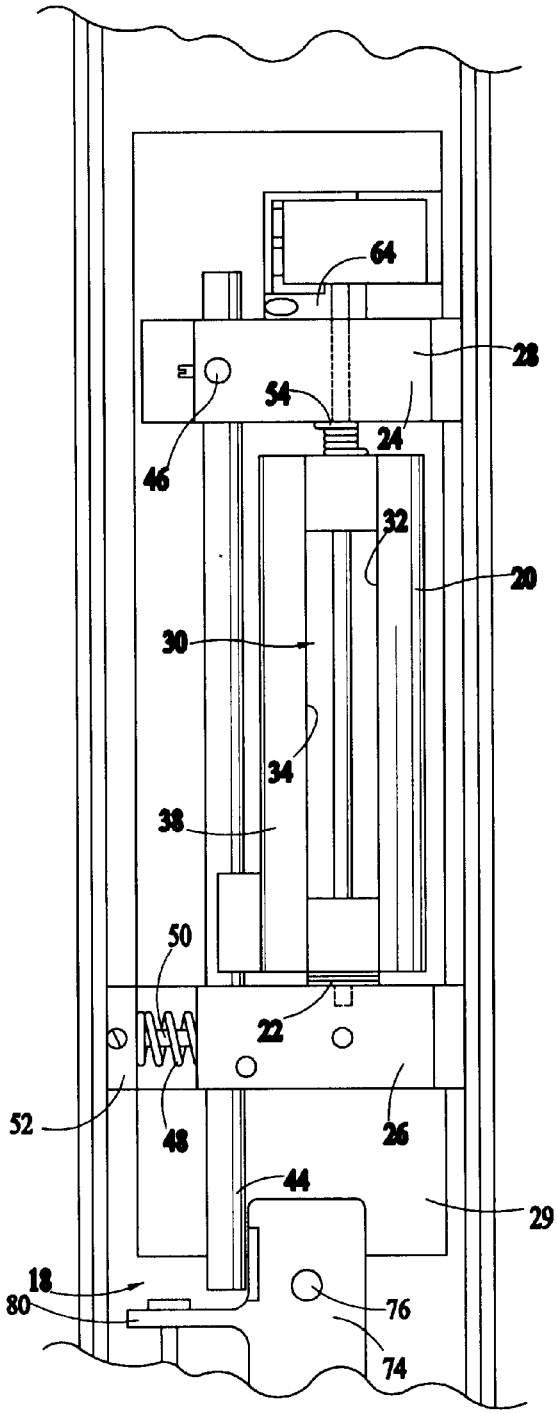
FIG. 4 is a perspective view of the door keeper of FIG. 2 in the open position.

In the following description of the preferred embodiment, reference is made to the accompanying drawings which form a part hereof and in which is shown by way of illustration a specific embodiment in which the invention may be practiced. It is to be understood that other embodiments may be utilized and structural changes may be made without departing from the scope of the present invention.

Referring now to the drawings, there is shown a door frame 10 on which is mounted a door 12 that is rotatable between open and closed positions on an axle defined by conventional hinges 14 and 16 (not shown in detail). The door 12 may be made of wood, solid glass or other conventional materials known in the art. A door keeper or door lock 18 is mounted within the door frame 10 at a location similar to that of conventional door locks. The door keeper of the present invention, however, may be placed at any one or more locations within the frame 10 or extending along a substantial vertical length of the frame. As will be described later in detail, alternate embodiments of the door keeper 18 may also be used to restrain and lock other door arrangements, such as sliding doors.

Figure 2:
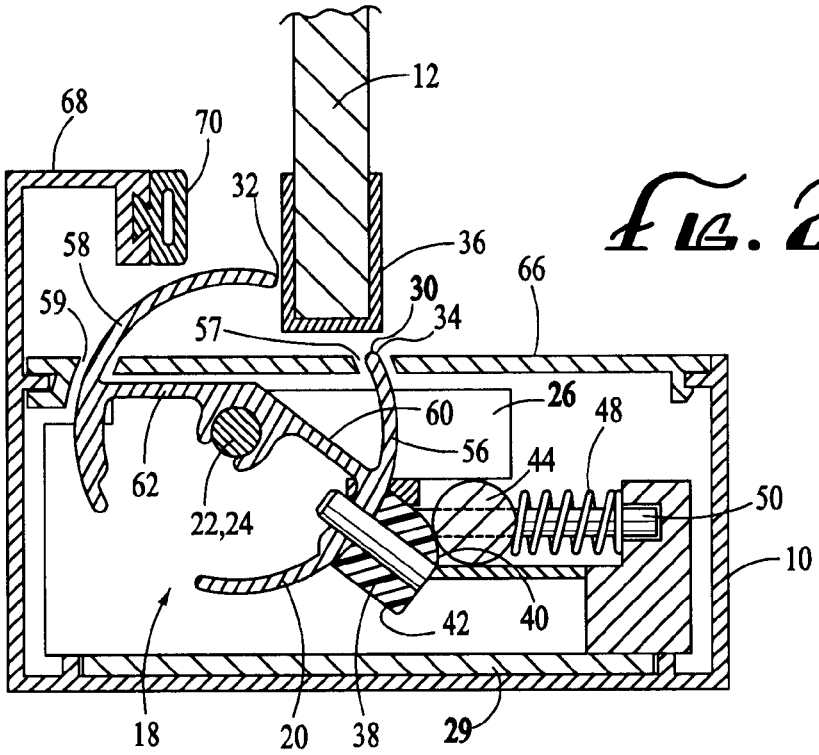
FIG. 2 is a cross-sectional view taken along lines 2—2 of an embodiment of the door keeper of the present invention in the open position.
Figure 3:
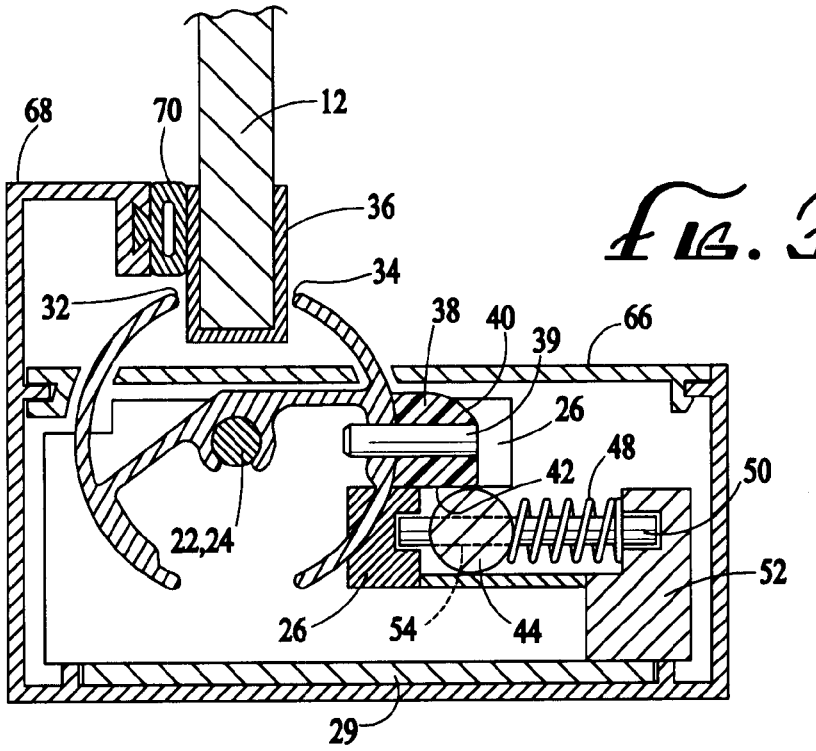
FIG. 3 is a cross-sectional view of the door keeper of FIG. 2 in the locked position.

As shown in FIGS. 2 and 3, the door keeper 18 includes a generally cylindrically shaped spindle 20 rotatably mounted by means of coaxial dowels 22 and 24 that extend between the spindle 20 and mounting blocks 26 and 28, respectively. Mounting blocks 26 and 28 are secured on base plate 29 which in turn is anchored to the interior portion of the door frame 10 and rigidly maintains the spindle 20 in place permitting the spindle 20 to rotate by means of the action of the dowels 22 and 24 from between open and locked positions. The spindle 20 includes a door receiving slot 30 having parallel edges 32 and 34 that traverse the length of the spindle 20 along its outer surface, such edges being parallel to an axis defined by dowels 22 and 24 and being spaced apart a dimension sufficient to receive an edge 36 of a conventional door 12.

A cam lobe 38 extends essentially outward from spindle 20 and has a sliding surface 40 and a locking surface 42. The cam lobe 38 may be fabricated of any number of known materials, such as Teflon®, that provides relatively rigid friction-free sliding surfaces. The cam lobe 38 may be secured to the spindle 20 in any number of conventional methods known in the art such as the interference fit pin 39. Positioned adjacent the cam lobe 38 is a spring loaded cam follower in the form of rod 44. Rod 44 extends between mounting blocks 26 and 28 and pivots about a dowel 46 that extend through the rod 44 and is secured in mounting block 28 by conventional means. The rod 44 is urged towards cam lobe 38 under the action of rod spring 48 and the rod 44 pivots about dowel 46 between positions that are in and out of contact with cam lobe 38. Rod spring 48 is compressible along transversely extending holding pin 50 which is rigidly secured in assembly block 52 and block 26. Block 52 is rigidly mounted to the inside portion of door frame 10, so that in combination with mounting block 26, provides a stationary anchor for pin 50. The rod 44 has a bore 54 positioned to be in alignment with pin 50 such that pivotal motion of rod 44 about dowel 46 results in a translational motion of rod 44 along pin 50. Rod spring 48 is positioned and configured to urge rod 44 towards cam lobe 38.

A torsion spring 54 is coupled to the spindle 20 and mounting block 28 and arranged to bias the spindle 20 to the open position as shown in FIG. 2. The spindle 20 has two cylindrical shell portions 56 and 58 rigidly held in place by means of structural ribs 60 and 62, respectively. As shown in FIGS. 2 and 3, the proximal ends of the ribs 60 and 62 are configured for a grip about dowels 22 and 24 so as to provide the rotary motion of spindle 20. Dowel 24 extends beyond mounting block 28 and carries rotation stop 64. Rotation stop 64 is fixedly mounted on dowel 24 and rotates in unison with spindle 20 such that when spindle 20 is rotated to the locked position (FIG. 3), the stop 64 comes into interference contact with door frame side 66 to prevent further rotation of the spindle 20.

Projecting outward from door frame 10 is an L-shaped door stop arm 68. The distal portion of stop arm 68 carries a flexible and compressible bushing 70. Door stop 68 provides an additional stopping contact surface for door 12 as the door is rotated to the closed position. Additionally, the door stop 68 provides a seal to inhibit air flow for environmental and fire containment considerations. The seal material may be formed of rubber or other flexible and compressible materials known in the art.

In operation, the spindle 20 is initially in the open position as shown in FIG. 2. Spindle shell portion 58 extends rotatably outward from door frame 10 through door frame opening 59 and in the path of travel of door 12, with shell portion 56 positioned within the frame 10. The rod 44 lies above and in the path of travel of cam lobe 38. As the door 12 is being closed, door edge 36 comes into contact with spindle edge 32. Further movement of door 12 to the closed position causes the spindle 20 to be rotated against the biased spring 54 to the closed or locked position (FIG. 3). As the spindle 20 rotates to the closed position, cam lobe 38 comes into sliding contact with rod 44 along sliding surface 40 against the bias of spring 48. Rod 44 is thereby moved in a direction to compress spring 48. During such spindle rotation, shell portion 56 rotates outward from frame 12 through door frame opening 57, and in combination with shell portion 58 confines door edge 36 between such door edges in locking engagement.

Upon reaching the locked position, the rod 44 under the influence of spring 48 is urged to move in a direction to decompress spring 48 and thus comes into contact with the underside of cam lobe 38 at the locking surface 42, thereby preventing the spindle 20 from rotating back to the open position. At such time, the door edge 36 comes into sealing contact with gasket 70 and rotation stop 64 comes into contact with frame side 66 to provide further rotational stop for spindle 20.

Figure 5:
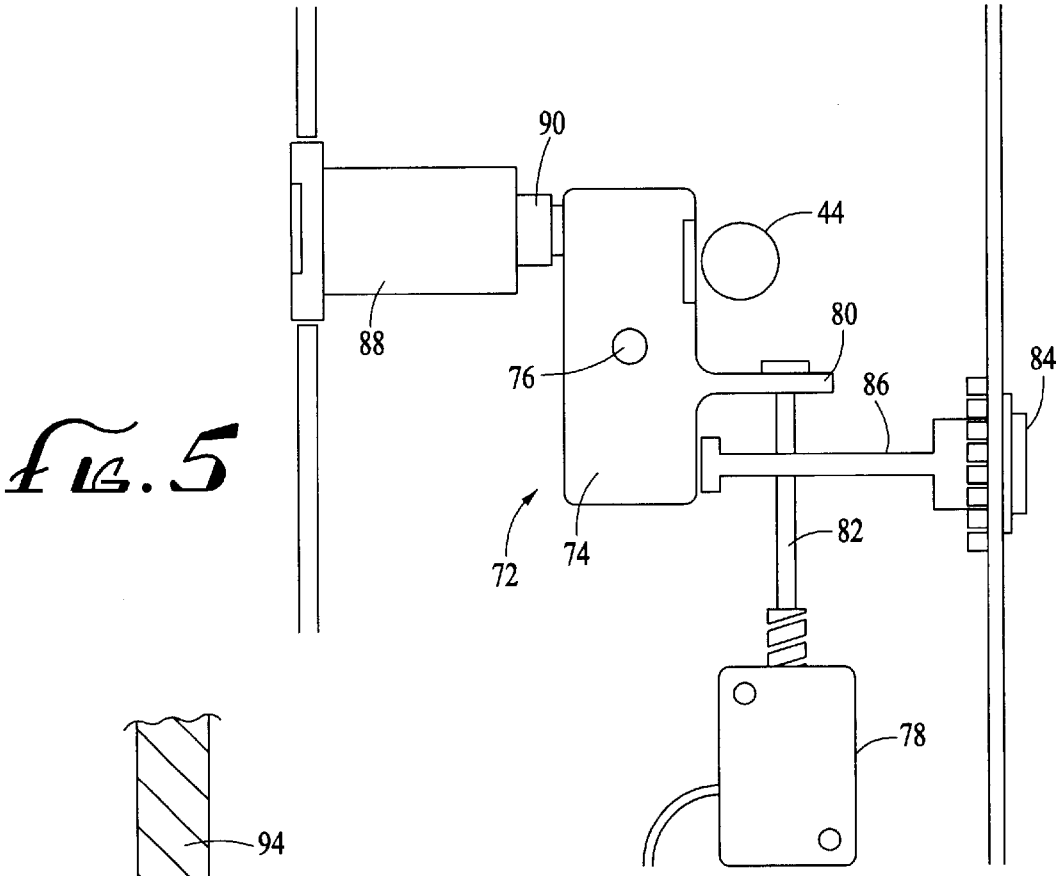
FIG. 5 is a top view of a lock releasing mechanism of the door keeper of FIG. 2.

Referring now to FIG. 5, there is shown a rod release mechanism 72 in a neutral position. The mechanism includes a lever 74 pivotable about pin 76 which is mounted on base plate 29. Coupled to the lever 74 are three mechanisms for selectable use in actuating the lever to release the lock and free the door. More specifically, a solenoid 78 is attached to lever arm 80 by means of solenoid arm 82. The lever 74 is shown adjacent the rod 44 such that when the solenoid is activated, solenoid arm 82 retracts, causing the lever 74 to rotate clockwise as viewed in FIG. 5, pushing the rod 44 away from and eventually out of contact with locking surface 42. With the rod 44 out of contact with cam lobe 38, the spindle is free to rotate to the open position at least under the action of torsion spring 54. Termination of solenoid actuation returns the lever 74 to its neutral position and the rod returns to a neutral position as shown in FIG. 2. The solenoid may be any one of a number of common devices known in the art. The solenoid 78 may be key operated in a manner similar to a hand held car door lock release or be activated at a remote location through internally wired systems or be gang operated for multiple door release systems.

A second method for actuation of the lever 74 is by means of push button 84 mounted typically on the interior room side of door frame 10. Push button 84 is coupled to lever 74 by means of push button rod 86. Upon pushing button 84 inward, rod 86 contacts lever 74 in a manner to rotate it clockwise about pin 76, thereby contacting and urging the rod 44 away from locking surface 42 in a manner similar to that accomplished with solenoid 78.

A third method for actuation of lever 74 is by means of push key mechanism 88. Push key 88 is coupled to lever 74 such that after insertion of the key into mechanism 88, rotation of the key causes key arm 90 to extend outward thereby urging the lever 74 in a clockwise direction to urge release the rod 44 away from lockring surface 42 in a manner previously discussed. Such key mechanism and variations are known in the art and are contemplated by the present invention. Similarly, other methods for actuating the lever 74 are also contemplated by the invention.

Figure 6:
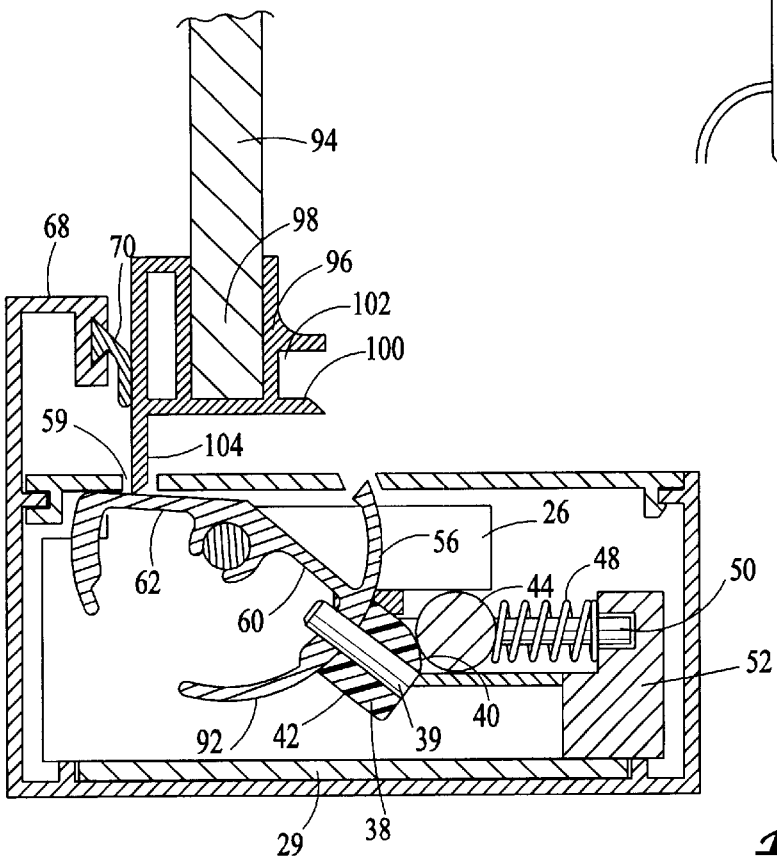
FIG. 6 is a cross-sectional view of an alternate embodiment of the door keeper of FIG. 2 showing a sliding glass door in the locked position.
Figure 7:
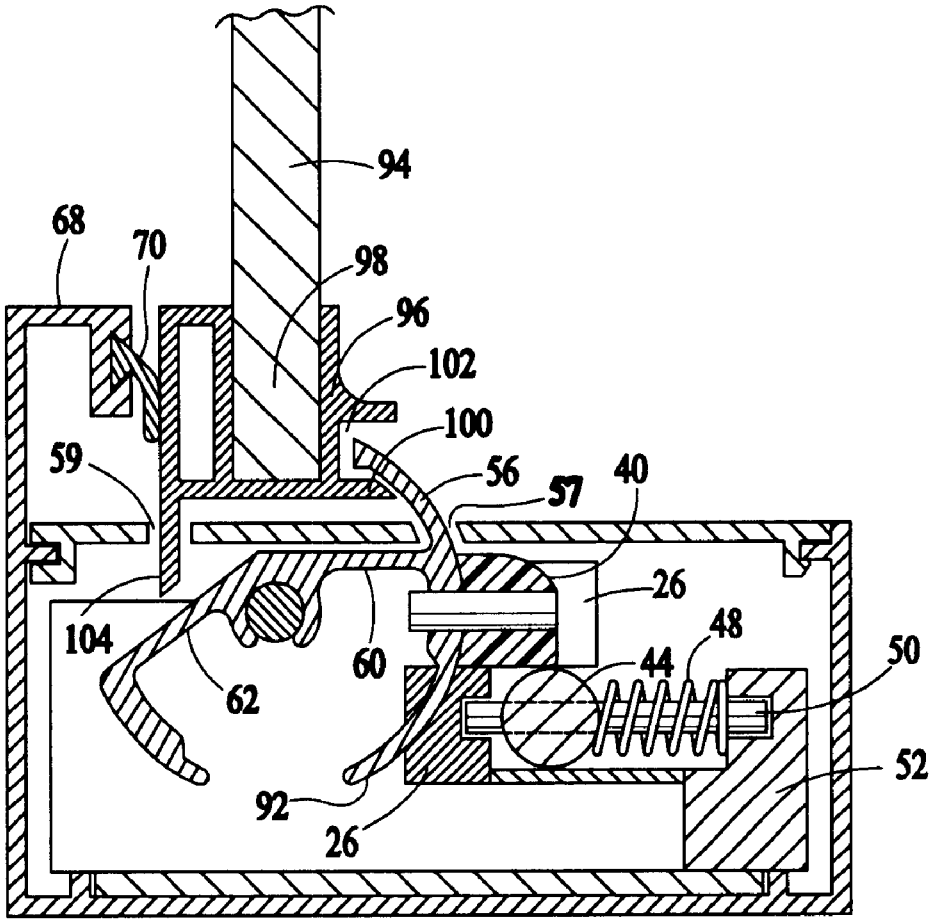
FIG. 7 is a cross-sectional view of an alternate embodiment of the door keeper of FIG. 6 showing a sliding glass door in the locked position.

An alternate embodiment of the present invention is shown in FIG. 6 and relates to a sliding door locking arrangement utilizing a modified version of the spindle 20 in combination with a door edge stile. More specifically, the spindle 92 of FIG. 6 (shown in the locked position) is the same as that of spindle 20 with the exception that shell portion 58 is omitted. A locking mechanism such as the cam lobe 38 and rod 44 locking arrangement, as described above, may also be used. The sliding door 94 may be a conventional sliding door arrangement known in the art. Such doors are typically made of glass and slide in a narrow restraining and guiding track between open and closed positions. The door of FIG. 6 includes a stile 96 anchored to the door edge 98 by any one of a number of techniques, such as durable adhesives known in the art. Stile 96 includes a locking edge 100 which forms one extension side of the channel 102. Stile 96 further includes push arm 104 which extends forwardly from the door edge 98. The push arm 104 is positioned in alignment with door frame opening 59, such that as the door 94 closes, arm 104 comes into contact with spindle rib 62 urging it against the bias of torsion spring 54 to rotate in the spindle 20 in the counterclockwise direction (as seen in FIG. 6) to the locked position. Simultaneously with such rotation, spindle shell portion 56 rotates outward through frame opening 57 to be positioned within channel 102 thereby locking door 94 in place by virtue of the interference action of shell portion 56 against locking edge 100. As in the case of the configuration of FIG. 2, gasket 70 in the form of a flexible projecting lobe comes into contact with the door 94 when in the closed position to form a tight seal therebetween. Releasing the lock may be accomplished in the same manner as described for the configuration of FIG. 2. In those instances where the door may be too heavy to be opened by the action of torsion spring 54 alone, manual assistance may be required to return the door to the open position. Upon release of the spindle lock, the spindle 20 is free to rotate in a clockwise direction (as viewed in FIG. 6) to the open position as the push arm 104 retracts away from the door frame and out of contact with spindle rib 62.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by the detailed description, but rather by the claims appended hereto.

What is claimed is:

1. A door lock mountable within a door frame comprising:

an essentially cylindrically shaped spindle rotatably mounted about a longitudinal axis for rotation between open and locked positions, the spindle having a slotted portion configured for rotatable extension outward from the frame and adapted to receive and confine therein an edge of a door so as to confine the door in place when the door lock is in the locked condition;

a spindle spring coupled to the spindle and configured to urge the spindle to rotate to the open position;

a rotation stop coupled to the spindle to prevent the spindle from rotating past the locked position;

a cam lobe mounted on the spindle and a spring loaded cam follower configured for sliding contact with the cam lobe between open and locked positions such that as the door is being closed the door contacts the slotted portion of the spindle thereby rotating the spindle to the locked position whereupon the cam follower moves into locking engagement with the cam lobe and the door is locked in place;

an articulating lever positioned adjacent the cam follower such that upon articulation, the lever urges the cam follower out of engagement with the locking portion of the cam lobe to thereby return the spindle to the open position; and a push button mounted on an outer side of the door frame and coupled to the articulating lever such that upon actuation of the push button, the articulating lever urges the cam follower out of engagement with the locking portion of the cam lobe to thereby return the spindle to the open position;

wherein the cam lobe has a sliding portion and a locking portion such that when the cam follower is urged into contact with the locking portion of the cam lobe, the spindle is prevented from rotating to the open position; and wherein the cam follower is spring loaded to bias the cam follower against the cam lobe and maintain the cam follower stationary when in engagement with the locking portion of the cam lobe.

* * * * *